US009631477B2

(12) United States Patent
Harmer et al.

(10) Patent No.: US 9,631,477 B2
(45) Date of Patent: Apr. 25, 2017

(54) DOWNHOLE DETERMINATION OF DRILLING STATE

(71) Applicant: Schlumberger Technology Corporation, Sugar Land, TX (US)

(72) Inventors: Richard Harmer, Surrey (GB); Walter David Aldred, Cambridgeshire (GB); Benjamin Jeffryes, Cambridge (GB); Adam Bowler, Headington (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 630 days.

(21) Appl. No.: 14/072,677

(22) Filed: Nov. 5, 2013

(65) Prior Publication Data

US 2014/0129148 A1 May 8, 2014

Related U.S. Application Data

(60) Provisional application No. 61/723,740, filed on Nov. 7, 2012, provisional application No. 61/724,681, filed on Nov. 9, 2012.

(51) Int. Cl.

| | |
|---|---|
| ***G06F 19/00*** | (2011.01) |
| ***E21B 47/024*** | (2006.01) |
| ***E21B 44/00*** | (2006.01) |

(52) U.S. Cl.

CPC ..... *E21B 47/024* (2013.01); *E21B 44/005* (2013.01)

(58) Field of Classification Search

CPC ..... H04W 84/18; G06F 1/00; G06F 2101/00
USPC ..... 702/9, 13, 182–185, 188
See application file for complete search history.

(56) References Cited

U.S. PATENT DOCUMENTS

| | | | | |
|---|---|---|---|---|
| 6,206,108 | B1 | 3/2001 | MacDonald et al. | |
| 6,220,087 | B1 | 4/2001 | Hach et al. | |
| 7,114,579 | B2 | 10/2006 | Hutchinson | |
| 7,128,167 | B2 | 10/2006 | Dunlop et al. | |
| 2003/0220742 | A1 | 11/2003 | Niedermary et al. | |
| 2004/0124012 | A1* | 7/2004 | Dunlop | G06N 7/005 175/57 |
| 2006/0065440 | A1 | 3/2006 | Hutchinson | |
| 2008/0164062 | A1 | 7/2008 | Brackin et al. | |

(Continued)

OTHER PUBLICATIONS

International search report and written opinion for the equivalent PCT patent application No. of PCT/US2013/068822 issued on Mar. 6, 2014.

(Continued)

*Primary Examiner* — Edward Raymond

(57) ABSTRACT

A method for determining a drilling state of a bottom hole assembly in a wellbore includes acquiring one or more downhole sensor measurements and processing the sensor measurements using a downhole processor to determine a drilling state of the bottom hole assembly. An operating state of the bottom hole assembly may be automatically changed in response to the determined drilling state. A method for computing a dynamic drilling energy of a bottom hole assembly includes acquiring at least one sensor measurement and processing the sensor measurements to obtain at least one of (i) an energy of axial motion of the bottom hole assembly, (ii) an energy of rotational motion of the bottom hole assembly, and (iii) an energy of lateral motion of the bottom hole assembly.

20 Claims, 2 Drawing Sheets

(56) References Cited

U.S. PATENT DOCUMENTS

2011/0214878 A1 9/2011 Bailey et al.

OTHER PUBLICATIONS

European Search Report under R.61 or R. 63 EPC Issued in corresponding EP application 13852677.7, Jul. 14, 2016. 3 pages.
Search Report issued in European Application 13852677.7 on Aug. 23, 2016. 6 pages.

* cited by examiner

DOWNHOLE DETERMINATION OF DRILLING STATE

CROSS REFERENCE TO RELATED APPLICATIONS

This application claims the benefit of U.S. Provisional Application Ser. No. 61/723,740 entitled Determining Drill State of Bottom Hole Assembly, filed Nov. 7, 2012 and U.S. Provisional Application Ser. No. 61/724,681 entitled Drilling Dynamic Energy Estimation, filed Nov. 9, 2012.

FIELD OF THE INVENTION

Disclosed embodiments relate generally to methods for downhole processing of drilling measurements and more particularly to a method for downhole processing of drilling measurements to obtain a drilling state such as a dynamic drilling energy of a bottom hole assembly while drilling.

BACKGROUND INFORMATION

The use of automated drilling methods is becoming increasing common in drilling subterranean wellbores. Such methods may be employed, for example, to control the speed and/or the direction of drilling. Automated methods may also be employed during measurement while drilling (MWD) or logging while drilling (LWD) operations to collect borehole and/or formation related data during drilling. While such methods are commonly used in the drilling industry, their utility may be improved by a downhole determination of the drilling state. For example, MWD and LWD tools may be configured to collect data only during certain drilling states (such as while rotary drilling) or a telemetry tool may be configured to automatically transmit data to the surface in certain drilling states.

The drilling state is generally known at the surface. For example, it is known whether the rig is being run it, tripping out, off bottom, rotary drilling, reaming, and the like. Moreover, surface equipment may be updated with changes to the drilling state. However, downhole tools are generally disconnected from the surface and are therefore "unaware" of the drilling state. While the drilling state may be transmitted from the surface to the bottom hole assembly (BHA), such transmission requires sufficient bandwidth and consumes valuable rig time (especially if a transmission is required after each change to the drilling state). A downhole determination of the drilling state may be timelier and therefore allow for more efficient automated control of various downhole tools. As such there is a need in the art for a method of making a downhole determination of the drilling state during a drilling operation.

SUMMARY

A method for determining a drilling state of a bottom hole assembly in a wellbore is disclosed. The method includes acquiring one or more downhole sensor measurements (e.g., including MWD and/or LWD sensor measurements) and processing the sensor measurements using a downhole processor to determine a drilling state of the bottom hole assembly. The operating state of at least one component in the bottom hole assembly may be automatically changed in response to the determined drilling state.

A method for computing a dynamic drilling energy of a bottom hole assembly is also disclosed. The method includes acquiring at least one sensor measurement (e.g., accelerometer and/or strain gauge measurements) from a corresponding sensor deployed in the bottom hole assembly. A downhole processor processes the sensor measurements to obtain at least one of (i) an energy of axial motion of the bottom hole assembly, (ii) an energy of rotational motion of the bottom hole assembly, and (iii) an energy of lateral motion of the bottom hole assembly. These energies may further be summed to obtain a total energy per unit length of the bottom hole assembly. The method may optionally further include automatically changing an operating state of at least one component of the bottom hole assembly in response one or more of the computed energies.

The disclosed embodiments may provide various technical advantages. For example, the disclosed embodiments enable the drilling state to be determined downhole without any surface communication or intervention. The drilling state may be used by a downhole controller (or controllers) to automatically direct various components of the BHA thereby saving valuable rig time. The disclosed embodiments also enable one or more components of the dynamic drilling energy of the BHA to be computed downhole. The computed energy may be used to improve drilling performance and mitigate dangerous dynamic conditions (such as bit bounce, stick slip, lateral vibrations, and bit whirl).

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
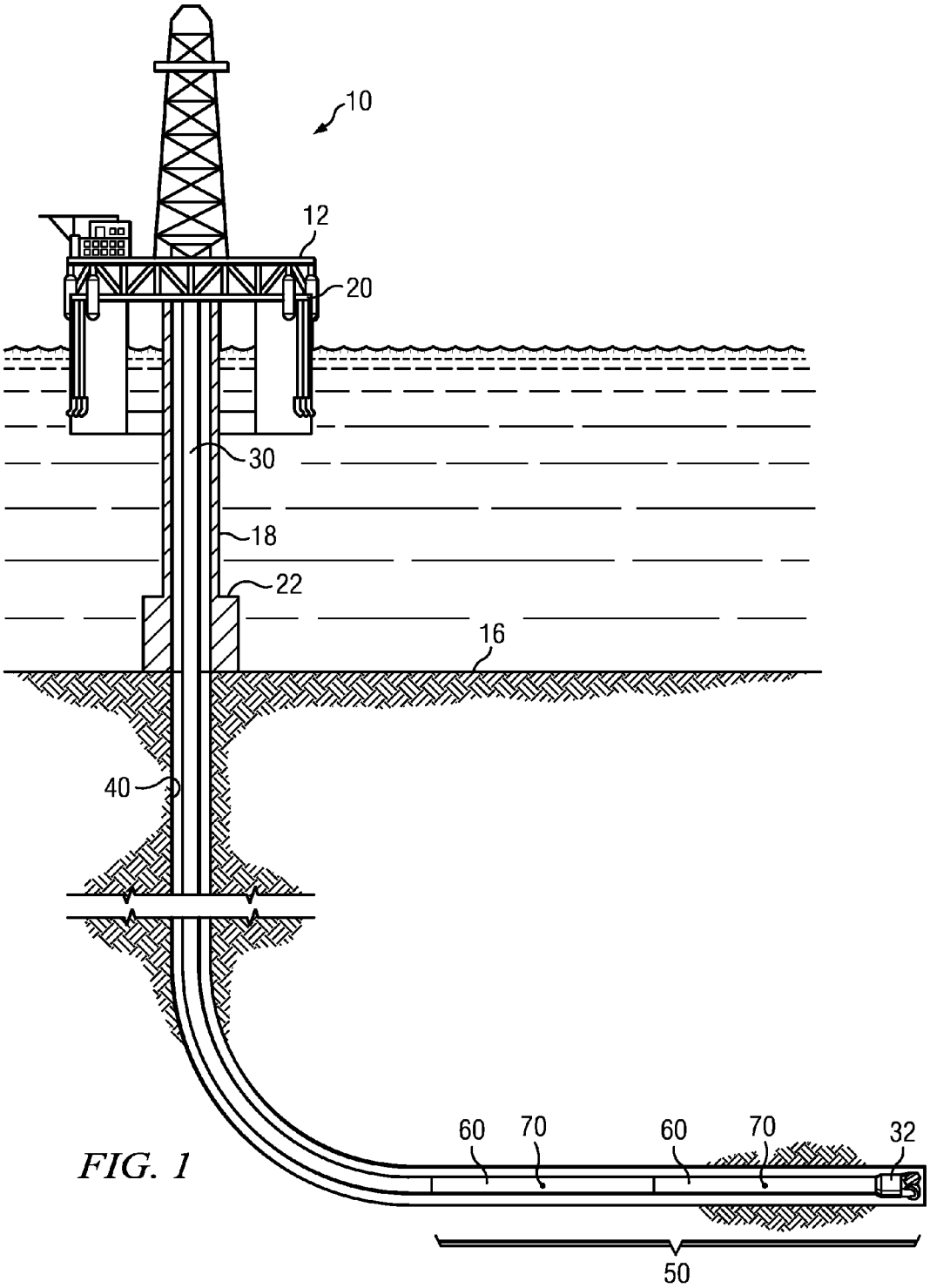
FIG. 1 depicts an example drilling rig on which disclosed embodiments may be utilized.

FIG. 1 depicts a drilling rig 10 suitable for using various method embodiments disclosed herein. A semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into borehole 40 and includes a bottom hole assembly (BHA) 50. The BHA includes a drill bit 32 and one or more additional downhole tools 60 (e.g., including measurement while drilling tools, logging while drilling tools, steering tools, and the like), and one or more downhole sensors 70 for measuring characteristics of the borehole 40, formation, and/or BHA 50. The BHA 50 may further include substantially any other suitable downhole tools such as a downhole drilling motor, a downhole telemetry system, a reaming tool, and the like. The disclosed embodiments are not limited in these regards.

It will be understood that downhole sensors 70 may include substantially any suitable sensor used in downhole drilling operations. Such sensors may include, for example, measurement while drilling sensors such as accelerometers, magnetometers, gyroscopes, and the like. The sensors may also include, for example, logging while drilling sensors such as a natural gamma ray sensor, a neutron sensor, a density sensor, a resistivity sensor, a formation pressure sensor, an annular pressure sensor, a temperature sensor, an ultrasonic sensor, an audio-frequency acoustic sensor, a caliper sensor, and the like. The sensors may also include sensors for measuring the characteristics of the BHA such as strain gauges for measuring various directional strain components in the BHA. The disclosed embodiments are not limited to the use of any particular sensor embodiments or configurations.

While not depicted the BHA 50 may include one or more downhole electronic controllers configured to collect and process the sensor data. By process the sensor data it is meant that the controller may evaluate the sensor data to obtain a downhole drilling state, for example, including an energy per unit length of the BHA (as described in more detail below). The controller may be further configured to execute such processing without surface intervention. It will be understood that the disclosed methods are not limited to any particular configuration of the controller or controllers, nor to any particular communication channels between the sensors and the controller and/or between multiple controllers. As such the controller may include substantially any controller suitable for downhole deployment. Such controllers commonly include one or more microprocessors and suitable memory.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
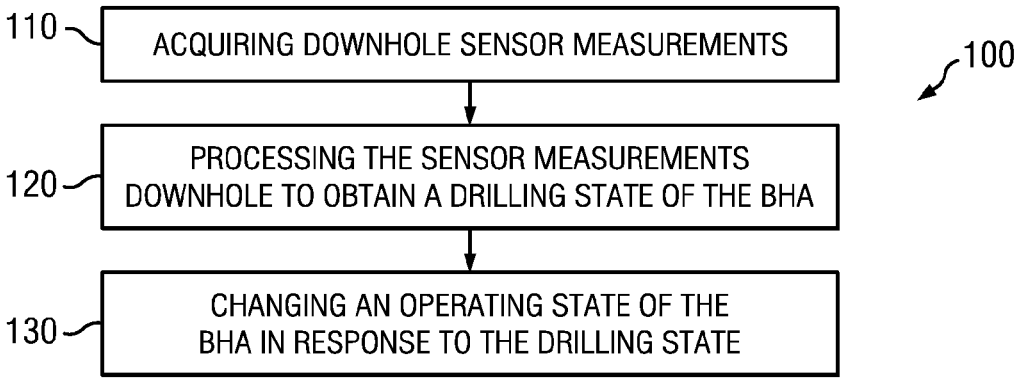
FIG. 2 depicts a flow chart of one disclosed method.

FIG. 2 depicts a flow chart of one disclosed method embodiment 100 for making a downhole determination of the drilling state. The method 100 includes acquiring (at 110) one or more downhole measurements of the BHA, the borehole, and/or the subterranean formation using downhole sensor(s) 70. The sensor measurements may be processed alone or in combination downhole at 120 using a downhole processor to determine the drilling state of the BHA. An operating state of one of the sensors and/or downhole tools 60 in the BHA 50 may then be changed at 130 in response to the drilling state determined at 120.

As stated above, the sensor measurements may include measurements of the BHA, the borehole, and/or the subterranean formation through which the borehole is being drilled. The sensor measurements may be indicative, for example, of drilling mechanics, drilling dynamics, the direction of drilling (the borehole azimuth and inclination), the size and shape of the borehole, and various formation properties. Drilling mechanics and drilling dynamics measurements may include the axial and/or rotational velocity of the BHA, the axial and/or rotational acceleration of the BHA, and the position of the BHA in the borehole. Drilling mechanics and drilling dynamics measurements may also include strain gauge measurements from which the stress and strain in the BHA may be determined. The measurements may also include measurements of the drilling fluid internal and external to the BHA, for example, including drilling fluid flow rate in the BHA, absolute pressure, and differential pressure. Such measurements are all known in the art.

The sensor measurements are processed downhole to obtain the drilling state. For example, the sensor measurements may be processed in combination with logic based on an understanding of the particular drilling operation to obtain the drilling state. For example, the sensor measurements may be processed in combination with the logic to discriminate between two or more of the following drilling states: rotary drilling, slide drilling, in slips, reaming, running in while pumping, running in while rotating, running in, tripping out, back reaming, pulling up while pumping, pulling up while rotating, pulling up, rotating off bottom, pumping off bottom, rotating and pumping off bottom, and stationary. It will be understood that such processing may include transmitting the sensor measurements between various downhole tools and/or downhole processors in the BHA, evaluating various sensor measurements as a function of time, and computing various quantities from the sensor measurements.

The processing of downhole measurements disclosed herein may include automated downhole calibration of weight, torque, and bending measurements. For example, a buoyed weight below a downhole tool such as a drilling mechanics module may measure weight and torque as a function of the borehole inclination, with the weight decreasing as inclination increases. The following table (Table I) shows weight and torque as a function of borehole inclination and assumes a mud weight (MW) of 12 ppg (lb/gal).

TABLE 1

| Weight in Air of Equipment Below | Buoyed Weight of Equipment Below | Bore Inclination (degrees) | | | | | | | | | | | | | | | | | |
|---|---|---|---|---|---|---|---|---|---|---|---|---|---|---|---|---|---|---|---|
| DMM (klbf) | DMM (klbf) | 0 | 5 | 10 | 15 | 20 | 25 | 30 | 35 | 40 | 45 | 50 | 55 | 60 | 65 | 70 | 75 | 80 | 85 | 90 |
| 5 | 4 | 4 | 4 | 4 | 4 | 4 | 4 | 4 | 3 | 3 | 3 | 3 | 2 | 2 | 2 | 1 | 1 | 1 | 0 | 0 |
| 10 | 8 | 8 | 8 | 8 | 8 | 8 | 7 | 7 | 7 | 6 | 6 | 5 | 5 | 4 | 3 | 3 | 2 | 1 | 1 | 0 |
| 15 | 12 | 12 | 12 | 12 | 12 | 12 | 11 | 11 | 10 | 9 | 9 | 8 | 7 | 6 | 5 | 4 | 3 | 2 | 1 | 0 |
| 20 | 16 | 16 | 16 | 16 | 16 | 15 | 15 | 14 | 13 | 13 | 12 | 11 | 9 | 8 | 7 | 6 | 4 | 3 | 1 | 0 |
| 25 | 20 | 20 | 20 | 20 | 20 | 19 | 19 | 18 | 17 | 16 | 14 | 13 | 12 | 10 | 9 | 7 | 5 | 4 | 2 | 0 |
| 30 | 25 | 25 | 24 | 24 | 24 | 23 | 22 | 21 | 20 | 19 | 17 | 16 | 14 | 12 | 10 | 8 | 6 | 4 | 2 | 0 |
| 35 | 29 | 29 | 28 | 28 | 28 | 27 | 26 | 25 | 23 | 22 | 20 | 18 | 16 | 14 | 12 | 10 | 7 | 5 | 2 | 0 |
| 40 | 33 | 33 | 33 | 32 | 32 | 31 | 30 | 28 | 27 | 25 | 23 | 21 | 18 | 16 | 14 | 11 | 8 | 6 | 3 | 0 |
| 45 | 37 | 37 | 37 | 36 | 36 | 35 | 33 | 32 | 30 | 28 | 26 | 24 | 21 | 18 | 16 | 13 | 10 | 6 | 3 | 0 |
| 50 | 41 | 41 | 41 | 40 | 39 | 38 | 37 | 35 | 33 | 31 | 29 | 26 | 23 | 20 | 17 | 14 | 11 | 7 | 4 | 0 |
| 55 | 45 | 45 | 45 | 44 | 43 | 42 | 41 | 39 | 37 | 34 | 32 | 29 | 26 | 22 | 19 | 15 | 12 | 8 | 4 | 0 |
| 60 | 49 | 49 | 49 | 48 | 47 | 46 | 44 | 42 | 40 | 38 | 35 | 32 | 28 | 25 | 21 | 17 | 13 | 9 | 4 | 0 |
| 65 | 53 | 53 | 53 | 52 | 51 | 50 | 48 | 46 | 43 | 41 | 38 | 34 | 30 | 27 | 22 | 18 | 14 | 9 | 5 | 0 |
| 70 | 57 | 57 | 57 | 56 | 55 | 54 | 52 | 50 | 47 | 44 | 40 | 37 | 33 | 29 | 24 | 20 | 15 | 10 | 5 | 0 |
| 75 | 61 | 61 | 61 | 60 | 59 | 58 | 56 | 53 | 50 | 47 | 43 | 39 | 35 | 31 | 26 | 21 | 16 | 11 | 5 | 0 |

TABLE 1-continued

| Weight in Air of Equipment Below | Buoyed Weight of Equipment Below | Bore Inclination (degrees) | | | | | | | | | | | | | | | | | | |
|---|---|---|---|---|---|---|---|---|---|---|---|---|---|---|---|---|---|---|---|---|
| DMM (klbf) | DMM (klbf) | 0 | 5 | 10 | 15 | 20 | 25 | 30 | 35 | 40 | 45 | 50 | 55 | 60 | 65 | 70 | 75 | 80 | 85 | 90 |
| 80 | 65 | 65 | 65 | 64 | 63 | 61 | 59 | 57 | 54 | 50 | 46 | 42 | 37 | 33 | 28 | 22 | 17 | 11 | 6 | 0 |
| 85 | 69 | 69 | 69 | 68 | 67 | 65 | 63 | 60 | 57 | 53 | 49 | 45 | 40 | 35 | 29 | 24 | 18 | 12 | 6 | 0 |
| 90 | 74 | 74 | 73 | 72 | 71 | 69 | 67 | 64 | 60 | 56 | 52 | 47 | 42 | 37 | 31 | 25 | 19 | 13 | 6 | 0 |
| 95 | 78 | 78 | 77 | 76 | 75 | 73 | 70 | 67 | 64 | 59 | 55 | 50 | 45 | 39 | 33 | 27 | 20 | 13 | 7 | 0 |
| 100 | 82 | 82 | 81 | 80 | 79 | 77 | 74 | 71 | 67 | 63 | 58 | 53 | 47 | 41 | 35 | 28 | 21 | 14 | 7 | 0 |

These downhole derived drilling states may be used to select periods in the drilling process where it is appropriate to automatically identify offsets to the downhole axial load and downhole torque to convert these to downhole weight and torque on the drill bit. The identification of the conditions under which to compute these offsets may also be a manual process performed on the surface by operators in the field. These calibrations may be refined by using measurements made by the tool in the specific environment in conjunction with information about the downhole drilling state to perform small calibrations to a downhole tool at specific points during the drilling process.

The drilling state may be further determined using a threshold based state detection methodology. For example, when the sensor measurements indicate that a measured parameter (e.g., the instantaneous or average value of the parameter or the standard deviation of the parameter) is above or below a particular threshold, the drilling state may be identified. For example, when the collar rotation rate is measured to exceed a predetermined threshold (such as 30 rpm) then the state may be set to be rotating. Likewise, when the sensor measurements indicate that a group of measured parameters are above or below corresponding thresholds, the drilling state may be identified (based on the relationship of the multiple measurements to the group of thresholds). For example, when the collar rotation velocity, the differential pressure, and the axial load all exceed corresponding thresholds, the state may be on bottom drilling. If the collar rotation velocity and differential pressure exceed the corresponding thresholds, but the axial load is below its corresponding threshold, then the state may be set to rotating and pumping off bottom.

It will be understood that a hysteresis may be applied to the various thresholds so as to avoid unwanted high frequency switching between the various drilling states. Such a hysteresis, for example, may utilize upper and lower thresholds with corresponding state changes only being indicated by a parameter value that exceeds the upper threshold or being below the lower threshold. In the example in the preceding paragraph, the axial load threshold may include upper and lower thresholds. When the axial load exceeds the upper threshold (and the rotation velocity and the differential pressure exceed corresponding thresholds) then the state may be set to on bottom drilling. A decrease in the axial load to a value between the lower and upper thresholds does not cause a corresponding state change. However, when the axial load is measured to be less than the lower threshold, the state may be automatically changed to rotating and pumping off bottom.

The drilling state may further be determined using a Bayesian network including upper and lower level states. For example, a downhole processor may be configured to recognize a sequence of logic based on transitions of lower level states and thereby select an upper level state (the drilling state). The lower level states may include, for example, the state of a particular sensor measurement with respect to a threshold. For example, when the measured rotation rate is above the threshold the lower level state may be rotating. Likewise, when the measured rotation rate is below the threshold (or a lower threshold) the lower level state may be not rotating. When the measured differential pressure is above a corresponding threshold, then the lower level state may be pumping. Likewise, when the measured differential pressure is below the threshold the lower level state may be not pumping. And so on. A combination of lower level states (or a sequence or timed sequence between the lower level states) may be taken to indicate an upper level state (a drilling state). In the example above, the combination of the lower level states rotating, pumping, and high axial load may be taken to indicate the on bottom drilling state.

A Bayesian network may further be utilized to indicate an interaction between various lower level states to indicate a probability of an upper level state occurring. For example, of the nature of the formation (abrasive or non-abrasive), the collar rotation rate, and the drill string inclination may be processed in combination to determine a probability of damaging bit whirl occurring. A Bayesian network may be further utilized to direct operational changes in the BHA.

The determined drilling state may then be further processed to direct one or more operational changes of the various downhole tools in the BHA. For example, when the drilling state changes from rotary drilling to pulling up, a downhole steering tool (such as a rotary steerable tool) may automatically be directed to stop steering. Alternatively, when the drilling state transitions to rotary drilling or back reaming, one or more logging while drilling tools (or sensors) may be directed to automatically collect logging data. Still further a measurement while drilling tool may be directed to obtain static surveys of the borehole when the drilling state is stationary. Yet further when the drilling state changes to off bottom pumping or off bottom pumping and rotating, a downhole telemetry system may be directed to transmit measurement while drilling data to the surface. The telemetry system may transmit information relating to specific events via on-demand frame technology to provide context specific information. With mud pulse telemetry there is a tradeoff between the transmission of measurements of the drilling process and formation evaluation information. The ability to automatically identify drilling states downhole allows information to be automatically sent uphole when the context is appropriate. Moreover, the determined drilling state may also be transmitted uphole.

The determination of drilling states may further be used to identify severe drilling events. As used herein, "severe events" (or dynamic events) refer to axial, radial, vibrational and/or rotational forces that may approach fatigue levels of the drill string, the bottom hole assembly, and/or the drill bit.

As is known to those of ordinary skill in the art, severe vibrational events or modes may reduce the drilling efficiency and/or increase the risk of drill string failure. The downhole drilling state (as determined downhole) may be used to direct the telemetry system to transmit drill string vibrational states or drill string energy values to the surface. The drill string vibrational states or drill string energy values may alternatively and/or additionally be used as inputs for controlling the drilling process, for example, in a closed loop control drilling system and/or as part of an automatic mitigation system.

Figure 3:
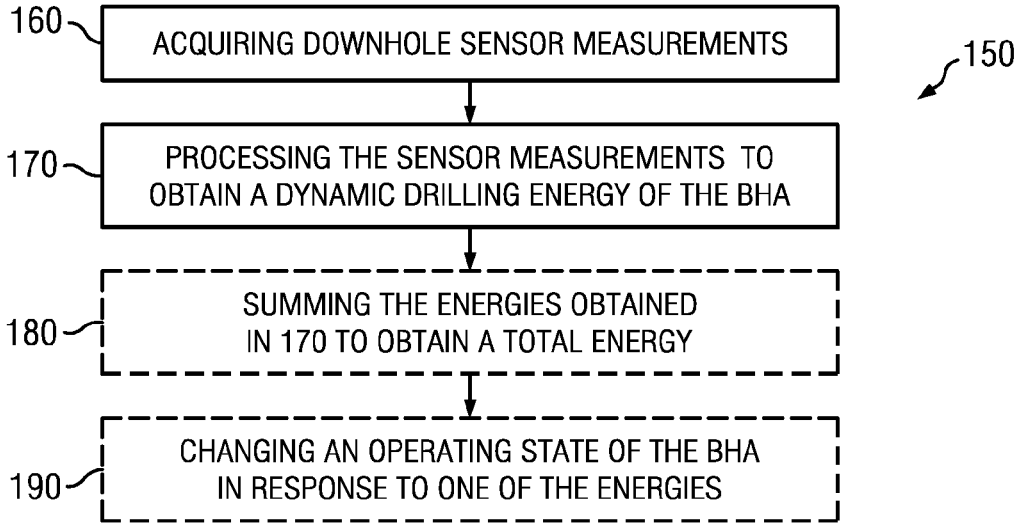
FIG. 3 depicts a flow chart of another disclosed method.

FIG. 3 depicts a flow chart of one disclosed method embodiment 150 for computing the dynamic drilling energy of a bottom hole assembly. The method includes acquiring at least one sensor measurement (e.g., accelerometer and/or strain gauge measurements) from corresponding sensors deployed in the bottom hole assembly at 160. A downhole processor processes the sensor measurements at 170 to obtain at least one of (i) an energy of axial motion of the bottom hole assembly, (ii) an energy of rotational motion of the bottom hole assembly, and (iii) an energy of lateral motion of the bottom hole assembly. These energies may further optionally be summed at 180 to obtain a total energy per unit length of the bottom hole assembly. The method may further optionally include automatically changing an operating state of at least one component of the bottom hole assembly at 190 in response one or more of the computed energies. It will be understood that in detecting severe events (such as the dynamic drilling energy of the drill string) it may be advantageous to make substantially instantaneous measurements (using rapidly acquired sensor data).

In order to compute the total drill string energy, up to four modes of drill string motion may be evaluated: rotational motion, axial motion, and first and second lateral or bending motions (in two directions such as x and y directions). The two lateral directions may include vertical and horizontal directions, for example, in a horizontal borehole. Each of the modes of motion may be characterized by or expressed as an energy per unit length of the BHA. For example, the rotational motion may be expressed as an energy of rotational motion ($E_{rotational}$), the axial motion may be expressed as an energy of axial motion ($E_{axial}$), and the lateral motion may be expressed as an energy of lateral motion ($E_{lateral}$) or first and second energies of lateral motion. Each of the modes of motion may be determined relative to a static frame of reference. The total energy $E_{total}$ per unit length of the BHA may be taken, for example, to be the sum of the energies per unit length associated with each mode of motion. In other words, $E_{total}$ may be taken to be the sum of $E_{rotational}$, $E_{axial}$, and $E_{lateral}$. The energy per unit length associated with each mode of motion may be expressed generally as follows:

$$E = \frac{1}{2}MV^2 + \frac{F^2}{2S} \qquad \text{Equation 1}$$

where E represents the energy per unit length, M represents the generalized mass per unit length, V represents the generalized velocity, F represents the generalized stress, and S represents the generalized stiffness per unit length, however, as described in more detail below these variables depend on the mode of drill string motion.

Of the variables in Equation 1, the mass M and the stiffness S are generally known (or determined at the surface prior to deployment in the wellbore) and may be preprogrammed into downhole memory. The velocity V and the stress F may be obtained from various downhole measurements and may be measured downhole during a drilling operation (e.g., while rotary drilling on bottom). For example, accelerometer measurements and/or magnetometer measurements may be utilized to obtain the velocity V and strain gauge measurements may be utilized to obtain the stress F. Accelerometer measurements may be used, for example, to obtain the instantaneous and/or average values of the axial, lateral, and rotational velocities while magnetometers may be used to measure the rotational velocity. The accelerometers may be deployed in the BHA so as to measure the acceleration in one or more directions. The accelerometers may measure instantaneous and/or averaged values of rotational acceleration, lateral acceleration, and/or axial acceleration. For example, the accelerometers may be deployed within or about the circumference of the BHA such that the measured accelerations may include rotational, axial, lateral acceleration components, and/or a combination thereof. For example, one or more accelerometers oriented in the axial direction may be used to obtain an axial velocity via integrating the axial accelerometer measurements. Likewise, one or more accelerometers oriented in a lateral direction may be used to obtain a lateral velocity via integrating the lateral accelerometer measurements. Similarly one or more accelerometers oriented tangentially about the circumference of the BHA may be used to obtain a rotational velocity via integrating the tangential accelerometer measurements. It will be understood that the disclosed embodiments are not limited to the use of any particular accelerometer arrangement. Other methods of using accelerometers to obtain BHA accelerations are also known in the art.

It will be understood that either DC coupled or AC coupled accelerometers may be used. DC coupled accelerometers are responsive to constant accelerations such as the Earth's gravitational field while AC coupled accelerometers tend to be responsive only to a dynamic (changing) acceleration. Those of ordinary skill in the art will readily be able to subtract the Earth's gravitational field from the DC coupled accelerometer measurements. The disclosed embodiments are not limited in these regards.

Magnetometer measurements may also be used to obtain the rotational velocity of the BHA. For example, one or more magnetometers may be used to measure the direction of the Earth's magnetic field. Rotation of the BHA in the borehole may cause the relative direction of the Earth's magnetic field to change such that differential magnetometer measurements may be used to obtain the rotational velocity of the BHA. Such methods are known in the art.

Strain gauges may be coupled to outer and/or inner surfaces of the BHA to obtain measurements of BHA strain. The output from the strain gauges may be processed to further obtain one or more parameters such as stress, torque, strain, bending moment, and the like. For example, various strain gauge measurements may be processed to obtain axial, lateral and torsional (rotational) strain in the BHA via multiplying the measured strain values by known elastic moduli of the BHA materials of construction.

Referring back to Equation 1, when calculating the energy of axial motion $E_{axial}$, M may represent a known mass per unit length of a portion of the BHA, V may represent the measured axial velocity, F may represent the measured axial stress, and S may represent a known axial stiffness per unit length of the BHA. The axial velocity V is not generally measured directly, but is computed from one or more accelerometer measurements. An axial accelerometer provides an axial acceleration measurement that may be used to calculate the axial velocity V, for example, through time-integration. Variations in the measured acceleration may be observed and may indicate variations in the axial velocity.

As mentioned above, accelerometers may concurrently measure both the BHA acceleration and gravitational acceleration components. Further, the gravitational acceleration component changes with changing borehole inclination. The gravitational acceleration component may be removed from the accelerometer measurements using techniques known to those of ordinary skill in the art. In some instances (e.g., in a horizontal wellbore), the gravitational acceleration component may be negligible as compared to the axial acceleration of the BHA.

The axial stress F may be obtained from the strain gauge measurements via the axial modulus of the BHA. Variations in the measured axial stress are often observed and may be caused, for example, by changes in the wellbore angle along the drill string. For example, the hanging weight below the strain gauges may change with the wellbore angle or may change due to other causes known in the art, thereby resulting in variations in the measured axial stress F.

When calculating the energy of rotational motion $E_{rotational}$ using Equation 1, M may represent a known rotational moment of inertia per unit length of the BHA, V may represent the measured angular rotation speed (rotational velocity) of the BHA, F may represent the measured torque, and S may represent a known rotational stiffness of the per unit length of the BHA. The energy of rotational motion may be calculated using the known values of M and S and the measured (or computed) values of V and F. The rotational velocity V of the BHA may be obtained from accelerometer and/or magnetometer measurements, for example, as described above. The torque F may be computed from tangential strain gauges as is also described above.

The energy of rotational motion $E_{rotational}$ may represent average values of rotational speed V and torque F, and may further represent the energy needed to fracture the formation during drilling. The energy required to fracture the formation may represent a combination of dynamic values (e.g., the energy resisting rotation while rotating) and static values (e.g., the energy required to begin rotation). The dynamic and static values may be subjected to a filtering process to separate the dynamic values from the static values to provide an estimation of an energy due to time-varying motion. The filtering process may include discriminating data above or below a specified frequency.

When calculating the energy of lateral motion $E_{lateral}$ using Equation 1, M may represent the known bending moment of inertia per unit length of the BHA, V may represent the measured lateral velocity of the BHA, F may represent the measured bending moment of the BHA, and S may represent the known rotational stiffness. The energy of lateral motion $E_{lateral}$ may be the lateral energy in first and/or second orthogonal directions. In a horizontal wellbore the first and second directions may be vertical and horizontal, for example. The first and second energies of lateral motion may of course be determined independently of each other using distinct velocity and bending moment measurements.

The measurements associated with the lateral motion may be high pass filtered to remove low-frequency noise. The measurements may also be corrected for the rotation of the drill string in the wellbore. For example, correcting for rotation may shift high-frequencies to low-frequencies, thereby creating additional low-frequency noise to be filtered. The bending measurements may also be high-pass filtered to remove low-frequency noise.

The lateral velocity V may be calculated by time-integrating the lateral accelerations measured using the accelerometers. The measured lateral acceleration may not be relative to a static frame of reference. For example, center mounted accelerometers measure the lateral acceleration relative to a rotating frame of reference. Offset mounted accelerometers rotate with the drilling tool to provide an offset motion of acceleration. The offset motion of acceleration may include acceleration from a combination of sources (e.g., including tool rotation and rotational acceleration). The offset motion of acceleration may also be used to calculate or estimate the center of motion acceleration. For example, to calculate or estimate the center of motion acceleration, the centripetal and rotational acceleration components may be removed or corrected to isolate the lateral acceleration relative to a rotating frame of reference, or the center of motion acceleration.

The lateral acceleration relative to a static frame may be calculated from the center of motion acceleration by correcting for the rotation of the BHA. Such correction may include rotating the center of motion accelerations relative to a non-rotating or static frame by determining an angle of the BHA relative to the static frame. One or more magnetometers and/or gyroscopes may be used to provide the angle of the BHA relative to the static frame (e.g., Earth's frame of reference). The angle of the BHA may also be determined by time-integrating gyroscopic measurements. While variations in the angle determined through time-integrated gyroscopic measurements may be observed, the variations may be negligible with respect to the energy of lateral motion $E_{lateral}$.

As noted above the lateral motion may include first and second directions. Thus the total lateral energy of the BHA may be computed using a modified form of Equation 1, for example, as follows:

$$E = \frac{1}{2}(M_1^2 + M_2^2)(V_1^2 + V_2^2) + \frac{F^2}{2S} \qquad \text{Equation 2}$$

where E represents the total lateral energy, $M_1$ represents the known bending moment of inertia per unit length in a first direction, $M_2$ represents the known bending moment of inertia per unit length in a second direction, $V_1$ represents the lateral velocity in the first direction, $V_2$ represents the lateral velocity in the second direction, F represents the bending moment, and S represents the bending stiffness per unit length. It will be understood that Equation 2 assumes that the measured bending moment is independent of the lateral direction (in other words that the bending moment in the first direction is substantially equal to the bending moment in the second direction). This is generally a reasonable assumption give the cylindrical nature of the BHA and the rotation of the BHA in the borehole.

The total energy per unit length of the BHA $E_{total}$ may be expressed as the sum of the energies in each mode, for example, the sum of the axial, the rotational, and the lateral energies described above. The total energy $E_{total}$ may be measured over an interval of time to provide an average total energy. Depending on the requirements of the operation, the time interval may be relatively short (e.g., 0.1, 0.3, or 0.5 seconds) or longer in duration (1, 3, or 5 seconds). Averaging also tends to reduce noise and may be accomplished, for example, via (i) averaging the computed energies or (ii) averaging the computed velocities and/or stresses in the BHA prior to computing an average energy. Substantially instantaneous total energy values may also be acquired.

The computed energies (e.g., the axial energy, the rotational energy, the lateral energy, and the total energy) may be evaluated with the intent of directing one or more operational responses. For example, if one or more of the energies are greater than corresponding predetermined thresholds (possibly indicating dangerous dynamic drilling conditions), a telemetry system may be instructed to automatically transmit a warning to the surface. A drilling operator may then change various drilling parameters (such as weight on bit and/or drill string rotation rate) to mitigate the dynamic conditions. A controller may also be configured to automatically mitigate the dynamic conditions without intervention from the surface.

In an alternative example, the sensors may be deployed above a positive displacement motor (a mud motor). In such a configuration, if the drill bit stops rotating it may be difficult to diagnose whether the motor has stopped rotating (e.g. stalled), or whether the drill bit has broken free from the BHA. In such a case, the energy of lateral motion and the energy of axial motion tend to drop significantly when the motor has stalled. Further indication of a stalled condition may be shown by a concurrent reduction in the rotation speed of the BHA. By processing the computed energies and various other sensor measurements, a downhole controller may be able to diagnose various downhole drilling conditions (such as the above mentioned stalled motor and dangerous dynamics conditions and a normal drilling condition). A telemetry system may be configured to automatically transmit the drilling condition to the surface in response to the computed energies.

The methods described herein are configured for downhole implementation via a controller deployed downhole (e.g., in the BHA 50). It will be understood that the controller may be configured to operate in both optimization and learning classification schemes. An optimization scheme may include collecting the sensor data, analyzing the data, and adjusting one or more operating states of the drilling system in response. The optimization scheme may also include maintaining one or more of the energies (or the total energy) associated with the modes of motion within predetermined ranges or below specified values by varying the operating state of the BHA. The operating state may include rate-of-penetration, weight on bit, rotation speed, flow-rate, and the like. The optimization scheme may also include monitoring one or more of the energies (or the total energy) associated with the modes of motion during one or more dynamic conditions (e.g., bit bounce, stick slip, and/or lateral vibrations of the BHA), adjusting one or more operating state to eliminate the dynamic conditions, and further adjusting the operating states to optimize the drilling system after eliminating the dynamic conditions. By monitoring the energies associated with the modes of motion during the elimination of the dynamic conditions, the controller may determine and/or predict optimal operating states for the drilling system.

Although methods for determining a downhole drilling state and certain advantages thereof have been described in detail, it should be understood that various changes, substitutions and alterations may be made herein without departing from the spirit and scope of the disclosure as defined by the appended claims.

What is claimed is:

1. A method for determining a drilling state of a bottom hole assembly in a wellbore, the method comprising:

(a) acquiring one or more downhole sensor measurements;

(b) processing the sensor measurements acquired in (a) using a downhole processor to determine a drilling state of the bottom hole assembly; and (c) automatically changing an operating mode of at least one component in the bottom hole assembly in response to the drilling state determined in (b).

2. The method of claim 1, wherein the downhole sensor measurements comprise at least one of measurement while drilling, logging while drilling, and strain gauge measurements.

3. The method of claim 1, wherein the drilling state of the bottom hole assembly is selected from the group consisting of rotary drilling, slide drilling, in slips, reaming, running in while pumping, running in while rotating, running in, tripping out, back reaming, pulling up while pumping, pulling up while rotating, pulling up, rotating off bottom, pumping off bottom, rotating and pumping off bottom, and stationary.

4. The method of claim 1, wherein the processing in (b) comprises comparing at one of the sensor measurements with a predetermined threshold.

5. The method of claim 4, wherein the predetermined threshold comprises an upper threshold and a lower threshold such that the sensor measurement must be above the upper threshold or below the lower threshold to cause a change in the drilling state.

6. The method of claim 1, wherein the (b) further comprises:

(i) processing a plurality of the sensor measurements to obtain a corresponding plurality of lower level states; and (ii) processing the lower level states to obtain the drilling state of the bottom hole assembly.

7. The method of claim 1, wherein the drilling state of the bottom hole assembly comprises a dynamic drilling energy per unit length of the bottom hole assembly.

8. The method of claim 1, further comprising:

(d) transmitting the drilling state obtained in (b) to a surface location.

9. A method for computing a dynamic drilling energy of a bottom hole assembly, the method comprising:

(a) acquiring at least one sensor measurement from a corresponding sensor deployed in the bottom hole assembly; and (b) causing a downhole processor to process the sensor measurement to obtain at least one of (i) an energy of axial motion of the bottom hole assembly, (ii) an energy of rotational motion of the bottom hole assembly, and (iii) an energy of lateral motion of the bottom hole assembly.

10. The method of claim 9, wherein (b) further comprises causing the downhole processor to obtain each of the (i) energy of axial motion of the bottom hole assembly, (ii) energy of rotational motion of the bottom hole assembly, and (iii) energy of lateral motion of the bottom hole assembly.

11. The method of claim 10, further comprising:

(c) causing the downhole processor to process the energy of axial motion, the energy of rotational motion, and the energy of lateral motion to obtain a total energy per unit length of the bottom hole assembly.

12. The method of claim 11, wherein the total energy per unit length of the bottom hole assembly is equal to the sum of the energy of axial motion of the bottom hole assembly, the energy of rotational motion of the bottom hole assembly, and the energy of lateral motion of the bottom hole assembly.

13. The method of claim 11, further comprising:

(d) automatically changing an operating state of at least one component of the bottom hole assembly in response to the total energy per unit length of the bottom hole assembly obtained in (c).

14. The method of claim 13, wherein said automatically changing an operating state of at least one component of the bottom hole assembly in (d) is operative to automatically maintain the total energy per unit length of the bottom hole assembly within a predetermined range of values.

15. The method of claim 9, wherein (b) further comprises:

(i) causing the downhole processor to process the sensor measurements to obtain an axial velocity of the bottom hole assembly and an axial stress in the bottom hole assembly; and (ii) causing the downhole processor to process the axial velocity of the bottom hole assembly and the axial stress in the bottom hole assembly in combination with a mass per unit length and an axial stiffness of the bottom hole assembly to obtain the energy of axial motion of the bottom hole assembly.

16. The method of claim 9, wherein (b) further comprises:

(i) causing the downhole processor to process the sensor measurements to obtain an angular rotational velocity of the bottom hole assembly and a torque on the bottom hole assembly; and (ii) causing the downhole processor to process the angular rotational velocity of the bottom hole assembly and the torque on the bottom hole assembly in combination with a rotational moment of inertia per unit length and a rotational stiffness of the bottom hole assembly to obtain the energy of rotational motion of the bottom hole assembly.

17. The method of claim 9, wherein (b) further comprises:

(i) causing the downhole processor to process the sensor measurements to obtain a lateral velocity of the bottom hole assembly and a bending moment of the bottom hole assembly; and (ii) causing the downhole processor to process the lateral velocity of the bottom hole assembly and the bending moment of the bottom hole assembly in combination with a bending moment of inertia per unit length and a bending stiffness per unit length of the bottom hole assembly to obtain the energy of rotational motion of the bottom hole assembly.

18. The method of claim 9, further comprising:

(c) automatically changing an operating state of at least one component of the bottom hole assembly in response to the at least one of (i) an energy of axial motion of the bottom hole assembly, (ii) an energy of rotational motion of the bottom hole assembly, and (iii) an energy of lateral motion of the bottom hole assembly obtained in (b).

19. The method of claim 18, wherein said automatically changing an operating state of at least one component of the bottom hole assembly in (c) is operative to automatically maintain at least one of the energy of axial motion of the bottom hole assembly, the energy of rotational motion of the bottom hole assembly, and the energy of lateral motion of the bottom hole assembly within corresponding predetermined ranges of values.

20. The method of claim 9, wherein the at least one sensor measurement comprises at least one of accelerometer measurements, magnetometer measurements, and strain gauge measurements.

* * * * *